US006488128B1

(12) United States Patent
Slabinski

(10) Patent No.: US 6,488,128 B1
(45) Date of Patent: Dec. 3, 2002

(54) INTEGRATED SHAFT SENSOR FOR LOAD MEASUREMENT AND TORQUE CONTROL IN ELEVATORS AND ESCALATORS

(75) Inventor: Chester J. Slabinski, New Hartford, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/735,371

(22) Filed: Dec. 12, 2000

(51) Int. Cl.[7] ..... B66B 3/00
(52) U.S. Cl. ..... 187/393
(58) Field of Search ..... 187/391, 392, 187/393; 73/131, 862.61, 862.627, 862.631, 862.44; 177/147, 211

(56) References Cited

U.S. PATENT DOCUMENTS 3,323,606 A * 6/1967 Bruns et al. ..... 187/29
4,506,554 A * 3/1985 Blomkvist ..... 73/862.36
4,566,341 A * 1/1986 Kovacs ..... 73/862.65
4,616,321 A * 10/1986 Chan ..... 73/151.5
4,766,977 A * 8/1988 Yamasaki ..... 187/20
5,156,239 A * 10/1992 Ericson et al. ..... 187/73

FOREIGN PATENT DOCUMENTS

EP 0953537 A2 * 11/1999

* cited by examiner

*Primary Examiner*—Jonathan Salata
(74) *Attorney, Agent, or Firm*—Wall Marjama & Bilinski LLP

(57) ABSTRACT

An elevator machine and control system includes a drive shaft with a motor and brake. A rope, usually a steel cable or belt, is attached at one end to an elevator car and at the other end to a counterweight. The rope is reeved around a traction sheave connected to the drive shaft. At least one torque sensor is integrated into the machine's drive shaft between the brake and the traction sheave. A controller operates the motor based in part upon a feedback signal received from the torque sensor. Depending on the location of the brake vis a vis the motor and traction sheave, either one sensor or two sensors are required to produce a feedback signal which is indicative of a load in the elevator car.

8 Claims, 1 Drawing Sheet

INTEGRATED SHAFT SENSOR FOR LOAD MEASUREMENT AND TORQUE CONTROL IN ELEVATORS AND ESCALATORS

FIELD OF THE INVENTION

This invention relates to the field of elevator and escalator control, and in particular, to the use of an integrated shaft sensor for load measurement and torque control.

BACKGROUND OF THE INVENTION

In an elevator system, one reason loadweighing is done is so that the elevator motor/machine can apply some torque before it lifts the brake that is holding an elevator car stationary at a floor where it is stopped. If the right amount of torque is applied based on the load, i.e., the number of people in the car, then the car remains motionless at the floor when the brake is lifted. If the correct amount of torque is not applied, the car lifts up or drops down a bit when the brake is lifted and before the motion control system takes control of operations. That lift up or drop down is known as rollback, and passengers do not like it at all. Other uses for loadweighing information include improved motion control of the car and making operating decisions such as, for example, anti-nuisance, overload, etc.

Loadweighing is conventionally done with sensors under the elevator car floor, but they are difficult to install, adjust, and maintain, and of course involve the added burden of putting in wires for the sensors, bringing the signals from the car up to the control system, etc. Platform systems suffer from inaccuracies due to friction in floor movement or imperfect distribution of the load.

Another way to do loadweighing is to put a sensor in the hitch, i.e., the place where the steel cables attach to the car. Hitch cells require top of car access for installation and service, and suffer inaccuracies from measuring small weight changes to the total car weight. Machine beam sensor systems have similar problems. This make the small change on top of a large weight problem worse, as the counterweight is now also being weighed.

SUMMARY OF THE INVENTION

Briefly stated, an elevator machine and control system includes a drive shaft with a motor and brake. A rope, usually a steel cable or belt, is attached at one end to an elevator car and at the other end to a counterweight. The rope is reeved around a traction sheave connected to the drive shaft. At least one torque sensor is integrated into the machine's drive shaft between the brake and the traction sheave. A controller operates the motor based in part upon a feedback signal received from the torque sensor. Depending on the location of the brake vis a vis the motor and traction sheave, either one sensor or two sensors are required to produce a feedback signal which is indicative of a load in the elevator car.

According to an embodiment of the invention, an elevator machine and control system includes a drive shaft; a motor operatively connected to the drive shaft, wherein the motor turns the drive shaft; a brake operatively connected to the drive shaft, wherein the brake stops the drive shaft from turning; a traction sheave operatively connected to the drive shaft, wherein turning the drive shaft turns the traction sheave; a rope reeved over the traction sheave; at least one torque sensor integrated into the drive shaft; and a controller for controlling the motor, wherein the controller receives a feedback signal from the at least one torque sensor.

According to an embodiment of the invention, an elevator machine and control system includes a drive shaft; a motor operatively connected to the drive shaft, wherein the motor turns the drive shaft; a brake operatively connected to the drive shaft, wherein the brake stops the drive shaft from turning; a traction sheave operatively connected to the drive shaft, wherein turning the drive shaft turns the traction sheave; a rope reeved over the traction sheave; wherein the rope is connected to an elevator car and a counterweight; at least one torque sensor integrated into the drive shaft between the brake and the traction sheave; and a controller for controlling the motor, wherein the controller receives a feedback signal from the at least one torque sensor.

DETAILED DESCRIPTION OF THE PREFERRED EMBODIMENT

Figure 1:
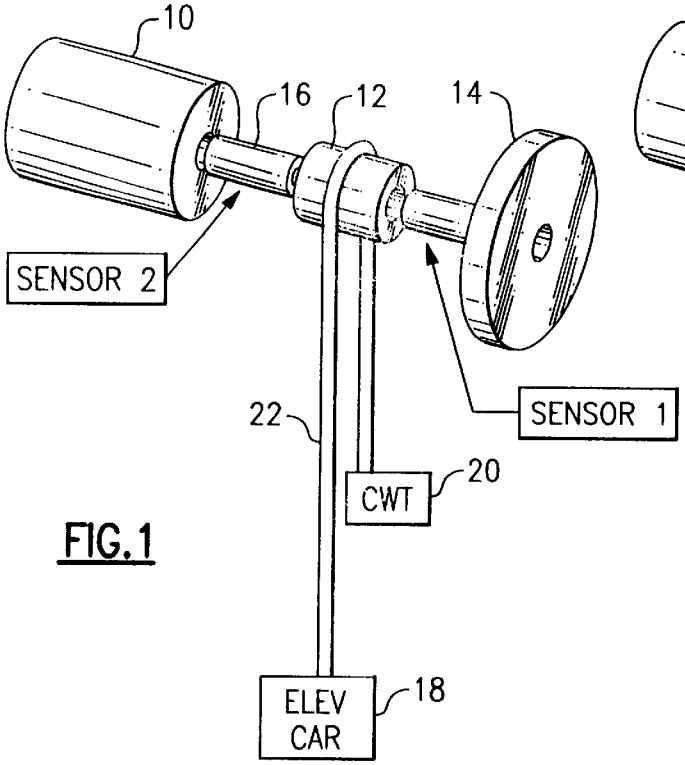
FIG. 1 shows an elevator "machine" with two torque sensors according to an embodiment of the invention.

Referring to FIG. 1, a motor 10, a traction sheave 12, a brake 14, and a drive shaft 16 which is continuous from motor to brake make up the elevator "machine." At rest, brake 14 holds shaft 16 to prevent it from rotating and thus holds an elevator car 18 while motor 10 is off. To move car 18, motor 10 pre-torques, brake 14 lifts, and motor 10 rotates shaft 16 to move car 18 up or down. A counterweight 20 balances a good part of the load and makes it easier to move. The "rope" between car 18 and counterweight 20 can be steel cable or a coated steel belt 22, as in the new generation of models from Otis Elevators.

Figure 2:
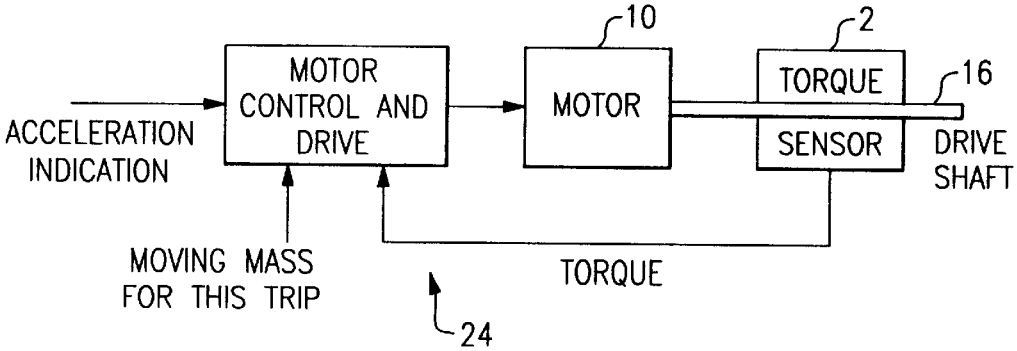
FIG. 2 shows a block diagram of the torque loop part of a control system for an elevator machine according to an embodiment of the invention.

Referring also to FIG. 2, the force that motor 10 produces, actually a torque in a rotating system, is controlled by a motion control system 24 to cause car 18 to accelerate and decelerate in a precise manner. It is desired to always move the same way, whether there is only one person in car 18 or there is a full car. For example, in New York City, the motion profile is often set to produce a fast aggressive stop and start to move people fast, while in Japan, the acceleration profile is set to a slow smooth and nearly imperceptible stop and start. To do motion control, a desired profile is preset in or dictated to control system 24.

The governing physics equation of F=ma requires that if the goal is to produce a defined acceleration profile with time, a force profile must be produced that depends on the load (m). Motor 10 is then given some power, the actual force (or torque) produced is measured, and the motor power is adjusted up or down to keep the force tracking the desired profile. This is the "force loop" or "torque loop" part of the motion control.

When car 18 is at rest, brake 14 is on and everything is motionless. Since brake 14 is on, a sensor 1 measures the torque being held by brake 14 from the unbalance of car 18 and counterweight 20, which is a measure of the load in car 18. A sensor 2 does not read any torque since it is on the "free" end of shaft 16 at this time and receives no torque from motor 10. To get ready to run and move car 18, the motor needs to pre-torque so that when brake 14 is lifted, car 18 does not have any rollback. To close the loop on the pre-torque in this arrangement, sensor 2 measures the torque being produced. Sensor 2 is also required while car 18 is running since sensor 1 is on the free end of the shaft during this time and would not measure any torque.

Figure 3:
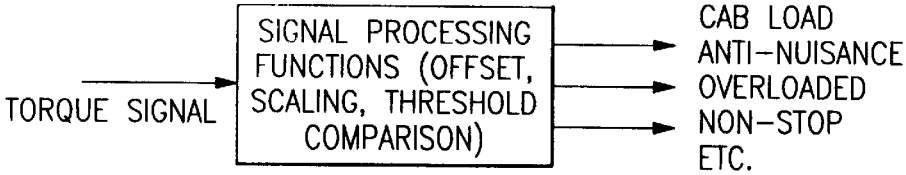
FIG. 3 shows how a torque signal from a torque sensor can be used to derive various load-related control signals.

Referring to FIG. 3, signal processing to derive load related signals from the torque value are preferably either in hardware circuits or in the control software. These load related control signals include offset, scaling, and threshold comparison to determine the exact value for the torque and load. The exact value of the torque or load is preferable to determine the elevator car mass, implement anti-nuisance controls, detect overloaded situations, and implement a car non-stop routine.

Figure 4:
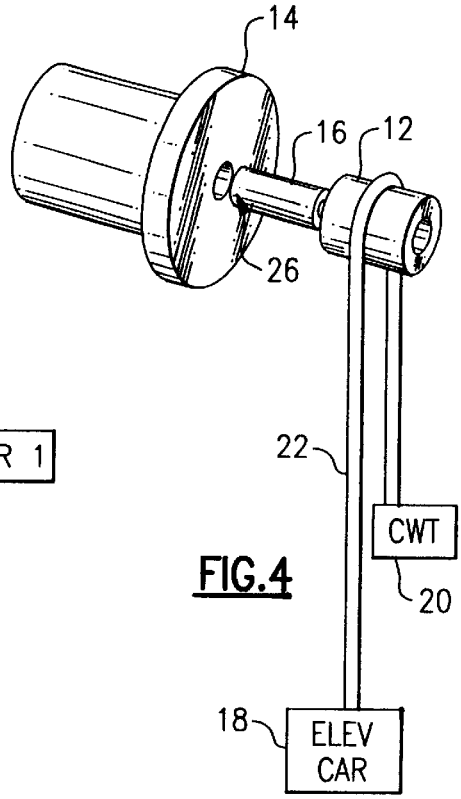
FIG. 4 shows an elevator machine with only one torque sensor according to an embodiment of the invention.

Referring to FIG. 4, if we switched the positions of brake 14 and traction sheave 12 on shaft 16, then a sensor 26 between brake 14 and sheave 12 would measure the static unbalance as before. With brake 14 lifted and car 18 running, sensor 26 provides the torque feedback to the torque loop. Before lifting brake 14, sensor 26 could not feedback the pre-torque, but this can be estimated by dictating an approximate amount of current to motor 10 to produce an approximate amount of the force required to prevent rollback. As soon as brake 14 lifted, the closed loop control could seize control and command the situation from there.

Examples of suitable sensors include the magnetoelastic torque sensors produced by Lebow Products Division, Eaton Corporation, Troy, Mich. Other examples of possibly suitable sensors include Cooper Instruments' LXT 960 torque sensing system and MDI's "Magna-lastic" torque sensors.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. An elevator machine and control system, comprising:

a drive shaft;

a motor operatively connected to said drive shaft, wherein said motor turns said drive shaft;

a brake operatively connected to said drive shaft, wherein said brake stops said drive shaft from turning;

a traction sheave operatively connected to said drive shaft, wherein turning said drive shaft turns said traction sheave;

a rope reeved over said traction sheave;

at least one magneto-elastic torque sensor integrated into said drive shaft; and a controller for controlling said motor, wherein said controller receives a feedback signal from said at least one torque sensor.

2. An elevator machine and control system, comprising:

a drive shaft;

a motor operatively connected to said drive shaft, wherein said motor turns said drive shaft;

a brake operatively connected to said drive shaft, wherein said brake stops said drive shaft from turning;

a traction sheave operatively connected to said drive shaft, wherein turning said drive shaft turns said traction sheave;

a rope reeved over said traction sheave;

at least one torque sensor integrated into said drive shaft; and a controller for controlling said motor, wherein said controller receives a feedback signal from said at least one torque sensor;

wherein said at least one torque sensor comprises first and second sensors, with said first sensor disposed in said drive shaft between said brake and said traction sheave and said second sensor disposed in said drive shaft between said traction sheave and said motor.

3. A system according to claim 1, wherein:

said brake is disposed on said drive shaft between said motor and said traction sheave; and said at least one torque sensor comprises only one sensor disposed in said drive shaft between said brake and said traction sheave.

4. A system according to claim 1, wherein said rope is connected to an elevator car and a counterweight, and wherein said at least one torque sensor measures a load in said elevator car when said elevator car is held at rest by said brake.

5. A system according to claim 1, further comprising means for processing said feedback signal to perform one of offset, scaling, and threshold comparison.

6. An elevator machine and control system, comprising:

a drive shaft;

a motor operatively connected to said drive shaft, wherein said motor turns said drive shaft;

a brake operatively connected to said drive shaft, wherein said brake stops said drive shaft from turning;

a traction sheave operatively connected to said drive shaft, wherein turning said drive shaft turns said traction sheave;

a rope reeved over said traction sheave; wherein said rope is connected to an elevator car and a counterweight;

at least one magneto-elastic torque sensor integrated into said drive shaft between said brake and said traction sheave; and a controller for controlling said motor, wherein said controller receives a feedback signal from said at least one torque sensor.

7. An apparatus according to claim 6, wherein said at least one torque sensor measures a load in said elevator car when said elevator car is held at rest by said brake.

8. An elevator machine and control system, comprising:

a drive shaft;

a motor operatively connected to said drive shaft, wherein said motor turns said drive shaft;

a brake operatively connected to said drive shaft, wherein said brake stops said drive shaft from turning;

a traction sheave operatively connected to said drive shaft, wherein turning said drive shaft turns said traction sheave;

a rope reeved over said traction sheave; wherein said rope is connected to an elevator car and a counterweight;

at least one torque sensor integrated into said drive shaft between said brake and said traction sheave; and a controller for controlling said motor, wherein said controller receives a feedback signal from said at least one torque sensor;

wherein said at least one torque sensor comprises first and second sensors, with said first sensor disposed in said drive shaft between said brake and said traction sheave and said second sensor disposed in said drive shaft between said traction sheave and said motor, wherein said first sensor measures torque when said elevator car is at rest and said second sensor measures torque when said elevator car is moving.

* * * * *